US005792079A

United States Patent [19]

Hatfield

[11] Patent Number: 5,792,079

[45] Date of Patent: Aug. 11, 1998

[54] PERINEAL-DISCOMFORT RELIEVING APPARATUS

[76] Inventor: Allen K. Hatfield, 3551 Hartzell Dr., Spring Valley, Calif. 91978

[21] Appl. No.: 881,325

[22] Filed: Jun. 24, 1997

Related U.S. Application Data

[60] Provisional application No. 60/033,926 Dec. 27, 1996.

[51] Int. Cl.[6] ..... A61H 1/00; A63B 21/00

[52] U.S. Cl. ..... 601/49; 482/72; 482/95; 482/114; 482/132; 482/135; 482/148; 601/24

[58] Field of Search ..... 482/51, 72, 92, 482/96, 131, 132, 135, 142, 145; 601/23, 24, 46, 49, 58, 100, 115, 116, 122

[56] References Cited

U.S. PATENT DOCUMENTS

| | | | |
|---|---|---|---|
| D. 152,394 | 1/1949 | Ceverha | 482/142 |
| 215,389 | 5/1879 | Ashton | 482/96 |
| 1,294,300 | 2/1919 | Noel, Sr. | 482/51 |
| 1,536,256 | 5/1925 | Calzetti . | |
| 1,982,872 | 12/1934 | Husted | 482/72 |
| 2,206,038 | 7/1940 | Ford . | |
| 2,714,507 | 8/1955 | Goodrich . | |
| 3,205,888 | 9/1965 | Stroop | 601/122 |
| 3,777,745 | 12/1973 | Simjian | 601/115 |
| 4,136,867 | 1/1979 | Wilkin . | |
| 4,700,945 | 10/1987 | Rader . | |
| 4,930,769 | 6/1990 | Nenoff . | |

FOREIGN PATENT DOCUMENTS

| | | | |
|---|---|---|---|
| 498342 | 5/1930 | Germany | 482/72 |
| 101838 | 11/1923 | Switzerland | 482/72 |

*Primary Examiner*—Richard J. Apley
*Assistant Examiner*—Victor K. Hwang
*Attorney, Agent, or Firm*—Frank G. Morkunas

[57] ABSTRACT

A perineal-discomfort relieving apparatus having a base member with a gripping member and a foot support member attached thereto, a slidable seat assembly on a seat support member, and a stimulating means, adjacent to the seat assembly and the seat support member. The stimulating means is configured of two opposing, off-set rows of alternating ribs and valleys and a set of rollers communicating therewith to permit a sliding movement of the seat assembly along the seat support member, wherein as a user sits on the seat assembly and slides it back and forth across the seat support member, the seat assembly contacts the ribs and valleys to create a vibrating and rocking motion adapted to relieve discomfort in the perineal region of a user.

15 Claims, 2 Drawing Sheets

PERINEAL-DISCOMFORT RELIEVING APPARATUS

CROSS REFERENCES TO RELATED APPLICATIONS

This application relates to my previously submitted Provisional Application, Ser. No. 60/033,926, filed on Dec. 27, 1996.

STATEMENT REGARDING FEDERALLY-SPONSORED RESEARCH OR DEVELOPMENT

Not applicable

BACKGROUND OF THE INVENTION

This present invention relates to an improvement in discomfort-relieving devices, and more particularly to an apparatus designed to relieve the discomforts in the perineal region related to problems associated with the prostate gland and the menstrual cycle.

Swelling of glands and muscles from the lower front pelvic region back to a point past the anus causes pain and discomfort for men and women. This area will be referred to as the perineal region or area. For men, an enlargement of the prostate gland can cause pain and interfere with the normal flow of urine from the urinary bladder through the penile urethra. For woman, during menstruation, the various organs and muscles associated with this cycle can cause pain, spasms, and other discomfort in the vaginal area and periurethral glands. For both, pain, swelling, and cramping of muscles, organs, and glands in the perineal area can be discomforting and, in some cases, debilitating. Apart from analgesics and diuretics, which in many cases offer no relief or remedy, no means of relief have been forthcoming.

For men with an enlarged prostate the normal flow of urine is interrupted. Even though the urge to urinate exists, a suitable volume of urine cannot be evacuated from the body because the swollen prostate partially occludes the urethra. A diuretic only heightens the need and urge but does not remove the blockage. This merely exacerbates the problem. During the course of the day, a person with an enlarged prostate is plagued with repeated urinary evacuations and, while asleep, repeated interruptions to such sleep. Repeated sleep deprivation leads to other health problems such as, but not limited to, stress, lethargy, and depression. For woman during their menstrual cycles, pain and spasms can be extremely unbearable. Though somewhat helpful, most analgesics provide little relief from the extreme discomforts associated with some menstrual cycles.

Up till now, no mechanical device or apparatus was devised to alleviate the discomforts addressed above in the manner of the present invention. The unique configuration of my apparatus has been proven to provide relief of some of the discomforts addressed above, and in particular, to the discomfort associated with an enlarged prostate and its attendant urinary distress. My invention looks like some, if not many, exercise cycles and rowing machines yet, although it substantially provides for a modicum of exercise, it is neither specifically configured nor functions like any. Moreover, the present invention provides relief from discomfort associated with prostate problems and menstrual cycles.

Through experimentation and testing, it has been found that urinary difficulties associated with a prostate problem, up to the point of complete blockage and sleep deprivation, have been alleviated after short use of this invention. In situations where an insufficient volume of urine (generally less than 100 ml) had been evacuated, after using my invention for about five to six minutes, a subsequent urinary discharge of approximately an equal amount of, and in many cases more, urine than the initial evacuation had been realized. In those instances involving a complete blockage, use of my invention for about five to six minutes has restored the urinary flow. In the past, the only means to restore the urinary flow was catheterization. This generally involved a trip to a hospital for professional catheterization or, after being so taught, conducting self-catheterization. My invention has eliminated the need for catheterization. No other device exists which is structured as is the present invention, functions as does the present invention, and provides desired relief to the user.

Similar-looking devices, however, exist but none are suited to provide the relief of the present invention. U.S. Pat. No. 4,930,769 issued on Jun. 5, 1990, to Nenoff, discloses a push-pull device having a slanted adjustable beam attached to a moveable seat with a gripping handle. A user lies supine on the seat, grips the handles, and pulls and pushes himself up and down. The purpose is to strengthen and tone the upper body, the function is to provide a smooth up-and-down motion, the structure associated with movement of the seat along the beam is suited for smooth, non-vibrating, non-rocking motion.

U.S. Pat. No. 2,206,038 issued on Jul. 2, 1940, to Ford discloses an orthopedic apparatus adapted to manipulate the limbs of a patient to flex and stretch the muscles to permit deformed bones to re-assume their natural position. The apparatus has a pivotably adjustable seat back rest for adjusting the angle of the patient's back when seated in the apparatus. The seat translates by means of rack and pinion gears on the seat and a track. The rack is tooth-like and the purpose is to provide for smooth, not vibrating, translation. Rollers and flanges on the apparatus are included to prevent the seat from wobbling during movement. The purpose of this prior art invention is to reform and realign mis-shapened bones, its function and teaching is contrary to that of the present invention, and its rack and pinion structure is clearly opposite in function, operation, and configuration than that of the present invention.

U.S. Pat. No. 4,136,867 issued on Jan. 30, 1979, to Wilkin, discloses an exercising wheel comprising a wheel with teeth around a circumference and a handle transversing the center of the wheel. The wheel is adapted for use on a floor by a user in a kneeling position who, while holding the handles, moves back and forth. The movement of the toothed wheel not only provides substantial exercise for the user, but also imparts stimulating vibrations to the user's body. The purpose, function, and structure of this invention is not similar to that of the present invention and, like the other prior art patents discussed above, fails to provide and account for perineal-discomfort relief in the manner of the present invention.

U.S. Pat. No. 1,536,256 issued on May 5, 1925, to Calzetti relates to a rowing machine which has ratchet teeth at the back of the support beam adapted to capture a transverse rod on the seat in order to limit or stop the backward stroke of the seat in use. This device also is configured for smooth, non-vibrating operation.

Additionally, none of the prior art inventions disclose the vibrating mechanism to comprise two rows of alternating ribs and valleys and their offset structure or the seat pressure ridge as does the present invention. Moreover, none suggests the rib apex-to-apex spacing ratio in relation to the rib height or the rib apex-to-apex spacing ratio in relation to the diameter of the rollers used as the translating means. These features, individually or in combination, present a marked improvement over the prior art and have produced significant discomfort-relieving results heretofore not achieved.

Accordingly, several objects and advantages of my invention are:

- to provide an offset vibration effect to a user's perineal region;
- to provide an offset rocking motion in addition to the vibration effect;
- to direct the vibration effect and rocking motion to the glands and muscles most affected in the perineal region by use of strategically placed pressure ridges;
- to provide a great degree of flexibility of use based on individual need by having adjustable pressure ridges adapted to adjust the firmness and softness thereof;
- to provide more direct comfort and relief to the glands, muscles, and organs of the perineal region which suffer from swell, spasm, pain, and cramping;
- to momentarily relieve the stress exerted on a man's penile urethra, due to an enlarged prostate occluding the urethra, to thereby permit, shortly after use of the apparatus, a more voluminous urinary discharge or the continuation of a previously interrupted urinary discharge; and
- to provide all the above objects at a low costing easy-to-use and easy-to-maintain apparatus.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a perineal-discomfort relieving apparatus having a base member with a gripping member and a foot support member attached thereto, a slidable seat assembly on a seat support member, and a stimulating means, adjacent to the seat assembly and the seat support member. The stimulating means is configured of two opposing, off-set rows of alternating ribs and valleys and a translating means to permit a sliding movement of the seat assembly along the seat support member, wherein as a user sits on the seat assembly and slides it back and forth across the seat support member, the seat assembly contacts the ribs and valleys to create a vibrating and rocking motion adapted to relieve discomfort in the perineal region of a user.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
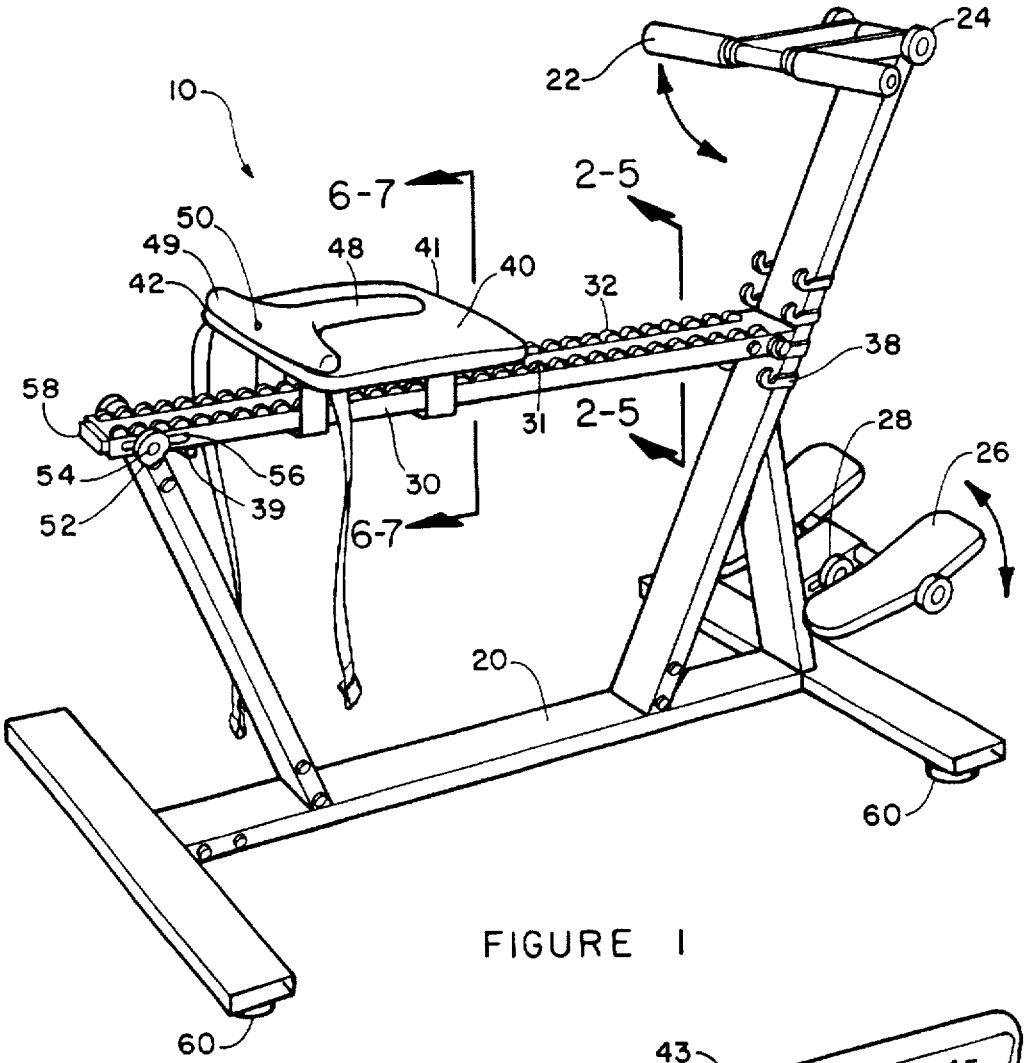
FIG. 1 is a perspective view of the discomfort relieving apparatus.

Referring now to the drawings in detail and in particular to FIG. 1, reference character 10 generally designates a perineal-discomfort relieving apparatus constructed in accordance with a preferred embodiment of the present invention. Base member 20 provides the foundational support with its plurality of post members (including, but not limited to horizontal, vertical, and diagonal posts) for connecting thereto the gripping member 22, the foot support member 26, and the seat support member 30. On the seat support member 30 is a seat assembly 40 which is adapted to translate across the seat support member. A stopping member 39 on the seat support member 30 prevents the seat assembly from being separated from the seat support member. Any conventional stopping device suited for the intended purpose may be used and such may be positioned at the back of the seat support member 30 or at any location substantially forward thereof. The stopping member also may be constructed on the seat assembly itself.

The gripping member 22 may be adjustable or fixed. If adjustable, it is adjusted to suit a particular user by the gripping member adjuster 24. The gripping member adjuster may be any conventional adjuster suited for the intended purpose including, but not limited to, a rotating threaded knob and mating bolt combination, tooth and pawl, and pin and orifice.

Similarly, the foot support member 26 may also be adjustable or fixed. In cases where it is adjustable, such adjustments are performed by a foot support member adjuster 28 to accommodate the needs of a particular user. Such foot support member adjuster 28 may be any conventional adjuster suited for the intended purpose including, but not limited to, tooth and pawl, and pin and multiple orifice.

The seat support member 30, may be fixed or it may be adjustable. Though my invention is more suited for discomfort relief wherein the seat support member 30 is fixed in a horizontal position, it may also serve secondary functions of exercise and muscle toning when it is constructed in such a fashion as to permit the seat support member 30 to be adjustable. Seat support adjuster 38 serves this purpose. By this adjuster, the front of the seat support member 30 may be raised or lowered above and below the relative horizontal and held in place in that position as a user engages the apparatus. In addition to providing the discomfort relief addressed above, such use also would provide a push- or pull-resistant, by gravity, to a user for exercise and toning muscles. The seat support adjuster 38 may be any conventional adjusting mechanism including, but not limited to, teeth and pawl, ratchet, and pin and multiple orifice. For the seat support adjuster 38 to properly function, the rear of the seat support member 30 is hollow and has inserted therein a seat support insert 58 onto which a threaded pin 54 is connected and which laterally extends through a slot 56 in the seat support member 30. The pin 54 slides within the slot 56 as the seat support member 30 is raised or lowered, as the case may be, to laterally expand or contract the seat support member 30. A threaded knob 52 communicates with the threads of the pin 54. Once the desired pitch is reached and held by the seat support adjuster 38, the knob 52 is tightened on the pin 54 to secure that position. Each of the respective adjusters are constructed on the respective member and the adjacent posts of the base member.

Figure 2:
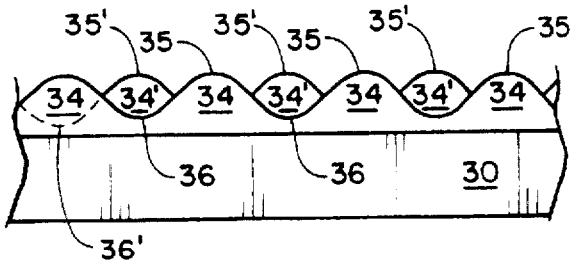
FIG. 2 is a partial detailed view of the seat support member taken on line 2—2 of FIG. 1 which shows the off-set configuration of the ribs.

The most important aspect to my invention, however, is the stimulating means which causes a subtle vibration and subtle rocking motion when used by translating the seat assembly 40 back and forth on the seat support member 30. In the preferred embodiment, this is shown by a first row 31 and a second row 32 of rib-like strips on the seat support member 30. Referring to FIG. 2, the first row in this view is shown to be in front. It has a plurality of ribs 34 and valleys 36. The apex of the rib is depicted by reference numeral 35. The second row is in back in this view. It also has a plurality of ribs 34' and valleys 36'. The apex of the rib is depicted by reference numeral 35'.

Figure 3:
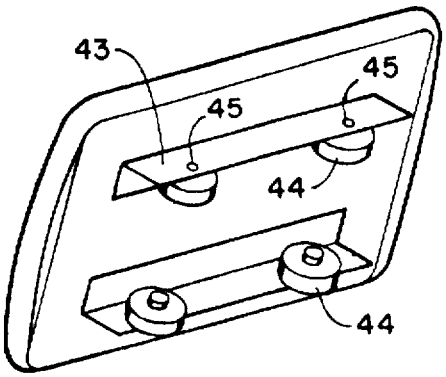
FIG. 3 is a perspective view of the underside of the seat assembly.

The height of the ribs can range from about ⅜" to about 7/16" more or less. The distance from apex to apex can range from about ⅜" to about 9/16" more or less. These importance of the ratios associated with these distances and dimensions has a direct effect on the subtlty of the vibration and rocking necessary to cause the desired effect and provide the relief sought thereby. In addition to the ribs and valleys, and referring now to FIG. 3, the underside of the seat assembly has plurality of rollers 44. The rollers 44 are attached by an axle pin 45 to a roller bracket 43. The roller bracket 43 is attached to the underside of the seat assembly. The rollers 44 are positioned to communicate directly with the first and second rows 31 and 32 of ribs and valleys. The rollers 44 permit the seat assembly 40 to move back and forth over the rows and valleys. As this movement is effected, the rollers 44 alternatingly rise up on the respective apexes 35 and 35' and descend into the respective valleys 36 and 36'. This rise and descent as the seat assembly 40 moves creates a vibration in the seat assembly. The vibration is transmitted to the user's perineal region.

In addition to the rise and descent associated with the rollers 44 communicating with the respective ribs and valleys of the first and second rows, a side-to-side rocking motion is also experienced. This is caused by the off-set pattern of ribs 34 and valleys 36 of the first row 31 in relation to the ribs 34' and valleys 36' of the second row 32. The rollers 44 on the underside of the seat assembly are substantially aligned with each other side to side. Therefore, as one side of the rollers 44 contacts a rib apex 35 on the first row 31, the opposing roller contacts a valley 36' on the second row 32 and so on. The back and forth movement of the seat assembly 40 across the seat support member 30 causes a subtle vibration and rocking motion suited to relieve discomfort in the perineal region of a user.

The rollers 44 have a diameter substantially between about 1¼" to about 1⅝", more or less. The diameter size of the rollers 44 in relation to the height of the ribs 34 and 34' and distance from rib apex to rib apex 35 and 35' is what creates that degree of subtle vibration and rocking suited to relieve perineal discomfort. In this regard, good results are achieved where the ribs 34 and 34' and valleys 36 and 36', respectively, bear a rib-height to a rib-apex-to-rib-apex ratio of about between 1.000:0.800 and 1.000:1.600, and where the rollers 44 bear a diameter ratio to a rib-apex-to-rib-apex ratio of about between 1.000:0.231 and 1.000:0.450.

Better results, however, are achieved where the ribs 34 and 34' and valleys 36 and 36', respectively, bear a rib-height to a rib-apex-to-rib-apex ratio of about between 1.000:1.000 and 1.000:0.501, and where the rollers 44 bear a diameter ratio to a rib-apex-to-rib-apex ratio of about between 1.000:0.300 and 1.000:0.346. Best results have been achieved with a rib-height to a rib-apex-to-rib-apex ratio of about 1.000:0.501, and where the rollers 44 bear a diameter ratio to a rib-apex-to-rib-apex ratio of about 1.000:0.346. Other ratios, though causing a vibration and rocking, do not afford the relief provided by the measurements addressed above.

Figure 4:
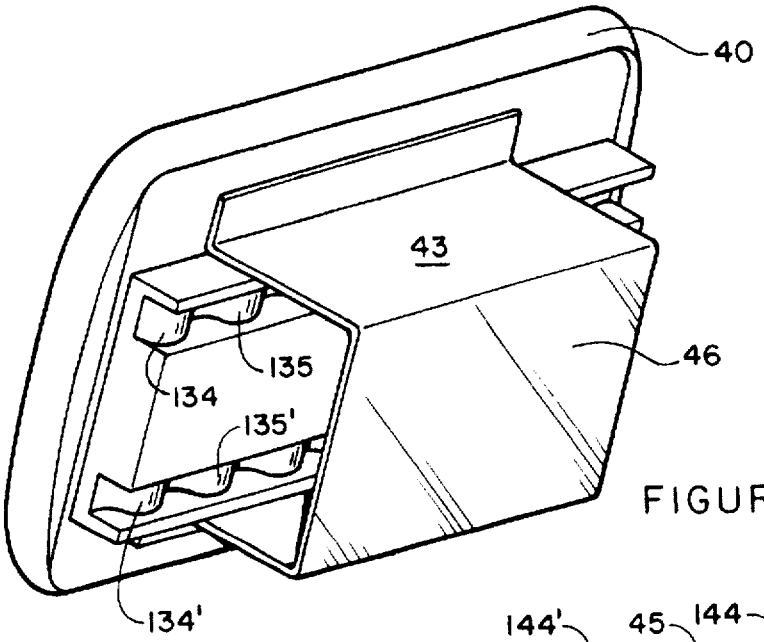
FIG. 4 is another embodiment of the underside of the seat assembly.
Figure 5:
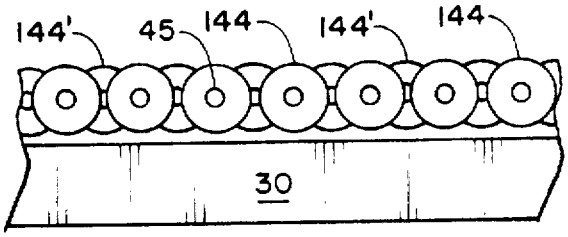
FIG. 5 is a partial detailed view of another embodiment of the seat support member taken on line 5—5 which shows the rollers to be off-set.

In another embodiment of my invention as shown in FIGS. 4 and 5, the ribs and valleys may be positioned on the underside of the seat assembly 40 and the rollers may be positioned on the seat support member. As seen in FIG. 4, each row has its respective ribs 134' and rib apexes 135'. In any embodiment, either the rows of ribs and valleys may be off-set with the rollers in transverse alignment or, as seen in FIG. 5, the opposing rollers may be off-set with the first row rollers 144 being laterally displaced from the second row rollers 144' and the rows of ribs and valleys in transverse alignment.

Figure 6:
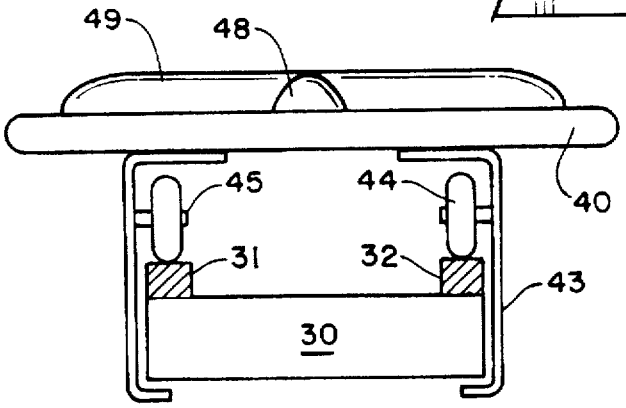
FIG. 6 is a section view of the seat support member taken along line 6—6 of FIG. 1.
Figure 7:
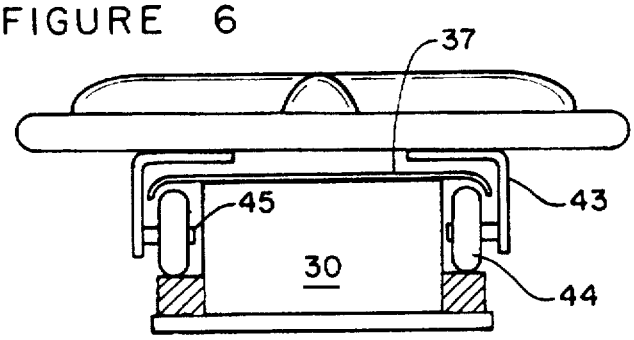
FIG. 7 is a section view of another embodiment of the seat support member taken along line 7—7 of FIG. 1.

In the preferred embodiment, the seat assembly 40 may ride on the top of a seat support member 30 as shown in FIG. 6. In this embodiment, the roller brackets 43, which have in inward turned bottom ends, secure the seat assembly 40 to the seat support member 30. Seat assembly 40 may also ride on a seat support member 30 which has a top ledge 37 with radial downward turned ends, forming a track, adapted to retain the rollers 44, and the seat assembly 40 thereby, as depicted in FIG. 7. Additionally, as shown in FIG. 4, the brackets 43 may also have a bottom member 46 connecting the opposing bracket sides to secure the seat assembly 40 to the seat support member 30.

The seat assembly 40 also defines a front 41 and a back 42. Positioned on top of the seat assembly is a T-shaped pressure ridge formed of a longitudinal pressure ridge 48 running from the front to the back of the seat assembly and a transverse pressure ridge 49 across the top of the longitudinal pressure ridge 48. This T-shaped pressure ridge facilitates the focus of vibration and rocking motion to the internal regions of need. Either the longitudinal pressure ridge 48 alone on the seat assembly 40, or the transverse pressure ridge 49 alone on the seat assembly 40, or both in combination, provide for a better focus of vibration and rocking where needed than a seat assembly without any ridge thereon. Best results, however, are achieved with the T-shape combination of longitudinal and transverse pressure ridges.

The pressure ridges should not be too hard but should be somewhat firm, fluid, and resilient. Such composition, however, may range from the soft to the fluid. In other words, there should be some resiliency to the composition of the ridges to accommodate the changing physical contours of the user as the seat assembly 40 translates back and forth. This provides for a more continuous focus of the subtle vibration and rocking motion previously discussed. I have found a more 'fluid' and resilient ridge, such as that which can be achieved by use of silicon, or similar substance inside the pressure ridge, provided good results. Such a filler more easily molds to the contours of the pressure ridge and more easily adapts to the changing contours of the user as the seat assembly 40 translates back and forth. Each individual user, however, will need a good deal of flexibility in this regard for best results in their particular case. For this contingency the pressure ridges also may be configured of an air-tight inflatable material adapted to receive and retain, or release, through a valve-like member 50, gas or air forced therein by an external device (not shown). By this manner, a user can adjust the feel, firmness, softness, and fluidity of the pressure ridges as suits his needs and provides the best results.

The apparatus also has levelers 60 on the base member 20 for the purpose of leveling the apparatus after it has been placed in any suitable location.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

The invention claimed is:

1. A perineal-discomfort relieving apparatus comprising:

a. a base member having a gripping member and a foot support member;

b. a seat support member attached to said base;

c. a seat assembly having a front and a back, said seat assembly attached to said seat support member and in translating communication therewith;

d. stimulating means adjacent to said support member and said seat assembly for providing a vibration effect and rocking motion to a user's perineal region, said stimulating means comprising a first row of alternating ribs and valleys, a second row of alternating ribs and valleys opposite said first row, and a translating means adjacent to said seat support member and said seat assembly for permitting translating movement of the seat assembly along the seat support member, whereby as said seat assembly translates across said seat support member as a user sits thereon, said translating means contacts said first row of ribs and valleys and said second row of ribs and valleys thereby creating a vibration and rocking motion adapted to relieve discomfort in the perineal region of a user, and, wherein said first row of ribs and valleys are offset from said second row of ribs and valleys such that the ribs of the first row oppose the valleys of the second row and the valleys of the first row oppose the ribs of the second row.

2. The apparatus as defined in claim 1 wherein said first and second rows of alternating ribs and valleys are positioned on opposing sides of said seat support member.

3. The apparatus as defined in claim 1 wherein said translating means comprises a plurality of rollers on an underside of said seat assembly.

4. The apparatus as defined in claim 1 wherein said first and second rows of alternating ribs and valleys are positioned on opposing sides of an underside of said seat assembly.

5. The apparatus as defined in claim 1 wherein said translating means comprises a plurality of rollers on opposing sides of said seat support member.

6. The apparatus as defined in claim 1 wherein said first and second rows of alternating ribs and valleys are positioned on opposing sides of said seat support member wherein said ribs and valleys bear a rib-height to a rib-apex-to-rib-apex ratio of about between 1.000:0.800 and 1.000:1.600, and said translating means comprises a plurality of rollers on an underside of said seat assembly wherein said rollers bear a diameter ratio to a rib-apex-to-rib-apex ratio of about between 1.000:0.231 and 1.000:0.450.

7. The apparatus as defined in claim 1 wherein said first and second rows of alternating ribs and valleys are positioned on opposing sides of an underside of said seat assembly wherein said ribs and valleys bear a rib-height to a rib-apex-to-rib-apex ratio of about between 1.000:1.000 and 1.000:0.501, and said translating means comprises a plurality of rollers on opposing sides of said seat support member wherein said rollers bear a diameter ratio to a rib-apex-to-rib-apex ratio of about between 1.000:0.300 and 1.000:0.346.

8. The apparatus as defined in claim 1 wherein said seat assembly comprises a substantially elevated longitudinal pressure ridge beginning substantially from the back of said seat assembly and terminating substantially adjacent to the front of said seat assembly.

9. The apparatus as defined in claim 8 wherein said longitudinal pressure ridge is substantially resilient having an air-tight hollow interior and a valve adapted to be adjustably pressure-filled to a degree of firmness suited to a particular user.

10. The apparatus as defined in claim 8 wherein said seat assembly further comprises a substantially elevated transverse pressure ridge adjacent to the back of said seat assembly and connected to said elevated longitudinal pressure ridge.

11. The apparatus as defined in claim 10 wherein said transverse pressure ridge is substantially resilient having an air-tight hollow interior and a valve adapted to be adjustably pressure-filled to a degree of firmness suited to a particular user.

12. The apparatus as defined in claim 1 wherein said gripping member includes means for adjusting its position to suit a particular user.

13. The apparatus as defined in claim 1 where in said foot member is adjustable wherein said foot member includes means for adjusting its position to suit a particular user.

14. The apparatus as defined in claim 1 wherein said seat support member includes means for adjusting its position relative to horizontal.

15. The apparatus as defined in claim 1 wherein said seat support member further has a stopping member connected thereto adapted to stop the translating movement of the seat assembly.

* * * * *